US011421910B2

(12) United States Patent
Baumann et al.

(10) Patent No.: US 11,421,910 B2
(45) Date of Patent: Aug. 23, 2022

(54) SINGLE-UNIT AIR CONDITIONER HAVING A MOVABLE FRONT PANEL

(71) Applicant: Haier US Appliance Solutions, Inc., Wilmington, DE (US)

(72) Inventors: Robert Edward Baumann, Shumway, IL (US); Neil Vincenti, Crestwood, KY (US); Brian Bernard McKay, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 425 days.

(21) Appl. No.: 16/562,554

(22) Filed: Sep. 6, 2019

(65) Prior Publication Data

US 2021/0071903 A1 Mar. 11, 2021

(51) Int. Cl.

| | |
|---|---|
| ***F25D 23/12*** | (2006.01) |
| ***F24F 13/20*** | (2006.01) |
| ***F24F 13/28*** | (2006.01) |

(52) U.S. Cl.

CPC ..... *F24F 13/20* (2013.01); *F24F 13/28* (2013.01)

(58) Field of Classification Search

CPC .. F24F 13/20; F24F 13/28; F24F 1/035; F24F 1/027; F24F 2221/26; F24F 2221/32

USPC ..... 62/259.1

See application file for complete search history.

(56) References Cited

U.S. PATENT DOCUMENTS

| | | | | |
|---|---|---|---|---|
| 5,379,609 | A * | 1/1995 | Matsumoto | B01D 46/4263 62/262 |
| 5,392,613 | A * | 2/1995 | Bolton | F24F 1/027 62/262 |
| 5,467,610 | A * | 11/1995 | Bolton | F24F 1/027 62/262 |
| 5,571,300 | A * | 11/1996 | Stemmer | B01D 46/10 55/DIG. 39 |
| 5,944,860 | A * | 8/1999 | Mack | B01D 46/0005 55/497 |
| 7,229,582 | B2 * | 6/2007 | Yamazaki | B29C 45/0017 264/250 |
| 8,752,399 | B2 | 6/2014 | Lingrey et al. | |

(Continued)

FOREIGN PATENT DOCUMENTS

| | | | |
|---|---|---|---|
| CN | 1553103 A | * | 12/2004 |
| JP | 2004138309 A | | 5/2004 |

*Primary Examiner* — Claire E Rojohn, III

(74) *Attorney, Agent, or Firm* — Dority & Manning, P.A.

(57) ABSTRACT

A single-unit air conditioner may include a housing, an outdoor heat exchanger assembly, an indoor heat exchanger assembly, a compressor, and a front panel. The housing may define an outdoor and indoor portion between a first lateral panel and a second lateral panel. The outdoor heat exchanger assembly may be disposed in the outdoor portion. The indoor heat exchanger assembly may be disposed in the indoor portion. The compressor may be in fluid communication with the outdoor heat exchanger assembly and the indoor heat exchanger assembly. The front panel may be slidably disposed on the housing at the indoor portion. The front panel may extend from a first lateral end to a second lateral end. The first lateral end may be selectively engaged with the first lateral panel. The first lateral end may include a lateral ridge directed inward toward a complementary attachment tab formed on the first lateral panel.

18 Claims, 6 Drawing Sheets

(56) References Cited

U.S. PATENT DOCUMENTS

| | | | | |
|---|---|---|---|---|
| 2005/0056037 | A1* | 3/2005 | Park | F24F 13/20 62/262 |
| 2007/0066215 | A1* | 3/2007 | Song | F24F 1/0071 62/317 |
| 2011/0120155 | A1* | 5/2011 | Lingrey | F24F 1/027 165/104.34 |
| 2017/0082317 | A1* | 3/2017 | McKay | F24F 13/224 |
| 2020/0124296 | A1* | 4/2020 | Baumann | F24F 1/027 |
| 2021/0071903 | A1* | 3/2021 | Baumann | F24F 1/035 |

* cited by examiner

SINGLE-UNIT AIR CONDITIONER HAVING A MOVABLE FRONT PANEL

FIELD OF THE INVENTION

The present subject matter relates generally to air conditioner appliances and more particularly to single-unit air conditioners having an easily-accessed front panel.

BACKGROUND OF THE INVENTION

Air conditioner or conditioning units are conventionally utilized to adjust the temperature indoors (i.e., within structures such as dwellings and office buildings). For example, one-unit type or single-package room air conditioner units, such as window units, single-package vertical units (SPVU), or packaged terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, a wall or window of the building. Generally, a fan may be operable to rotate to motivate air through the indoor portion. Another fan may be operable to rotate to motivate air through the outdoor portion. A sealed system including a compressor is generally housed within the air conditioner unit to treat (e.g., cool or heat) air as it is circulated through, for example, the indoor portion of the air conditioner unit.

One issue that may arise during the use of a conventional air conditioner is the presence of dust, debris, or allergens. In particular, such dust, debris, or allergens may accumulate within or recirculate through the indoor portion of the air conditioner. This may create an undesirable condition within the room. Additionally or alternatively, the accumulated or recirculated dust, debris, or allergens may be detrimental to performance (e.g., efficacy or efficiency) of the air conditioner unit. Some existing systems have incorporated air filters to address such issues. However, such air filters are often mounted within the air conditioner in such a way that accessing or replacing the air filter is very difficult. Often, a user must use multiple tools or disassemble an entire front housing (e.g., covering the indoor portion) to even view the air filter. This inconvenience may lead to irregular replacement or cleaning of the air filter. Additionally or alternatively, removing a large portion of a housing may provide access to features (such as controller) that should not be accessed or altered by a typical user (e.g., due to the risk of damage or injury). Still further, the configuration of existing system requires relatively low-quality or efficacy filters, that are only suitable to filter or remove relatively large particles.

As a result, an air conditioner addressing one or more of the above issues would be useful. In particular, it may be advantageous to provide an air conditioner having one or more features that could be easily removed (e.g., without the use of tools), such as without removing an entire front housing.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a single-unit air conditioner is provided. The single-unit air conditioner may include a housing, an outdoor heat exchanger assembly, an indoor heat exchanger assembly, a compressor, and a front panel. The housing may define an outdoor portion and an indoor portion between a first lateral panel and a second lateral panel. The outdoor heat exchanger assembly may be disposed in the outdoor portion. The indoor heat exchanger assembly may be disposed in the indoor portion. The compressor may be in fluid communication with the outdoor heat exchanger assembly and the indoor heat exchanger assembly to circulate a refrigerant therebetween. The front panel may be slidably disposed on the housing at the indoor portion. The front panel may extend from a first lateral end to a second lateral end. The first lateral end may be selectively engaged with the first lateral panel. The first lateral end may include a lateral ridge directed inward toward a complementary attachment tab formed on the first lateral panel.

In another exemplary aspect of the present disclosure, a single-unit air conditioner is provided. The single-unit air conditioner may include a housing, an outdoor heat exchanger assembly, an indoor heat exchanger assembly, a compressor, and indoor fan, and a front panel. The housing may define an outdoor portion and an indoor portion between a first lateral panel and a second lateral panel. The outdoor heat exchanger assembly may be disposed in the outdoor portion. The indoor heat exchanger assembly may be disposed in the indoor portion. The compressor may be in fluid communication with the outdoor heat exchanger assembly and the indoor heat exchanger assembly to circulate a refrigerant therebetween. The indoor fan may be rotatably disposed within the indoor portion in fluid communication with the indoor heat exchanger assembly. The front panel may be slidably disposed on the housing at the indoor portion below the indoor fan along a vertical direction. The front panel may extend from a first lateral end to a second lateral end. The first lateral end may be selectively engaged with the first lateral panel. The first lateral end may include a lateral ridge directed inward toward a complementary attachment tab formed on the first lateral panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
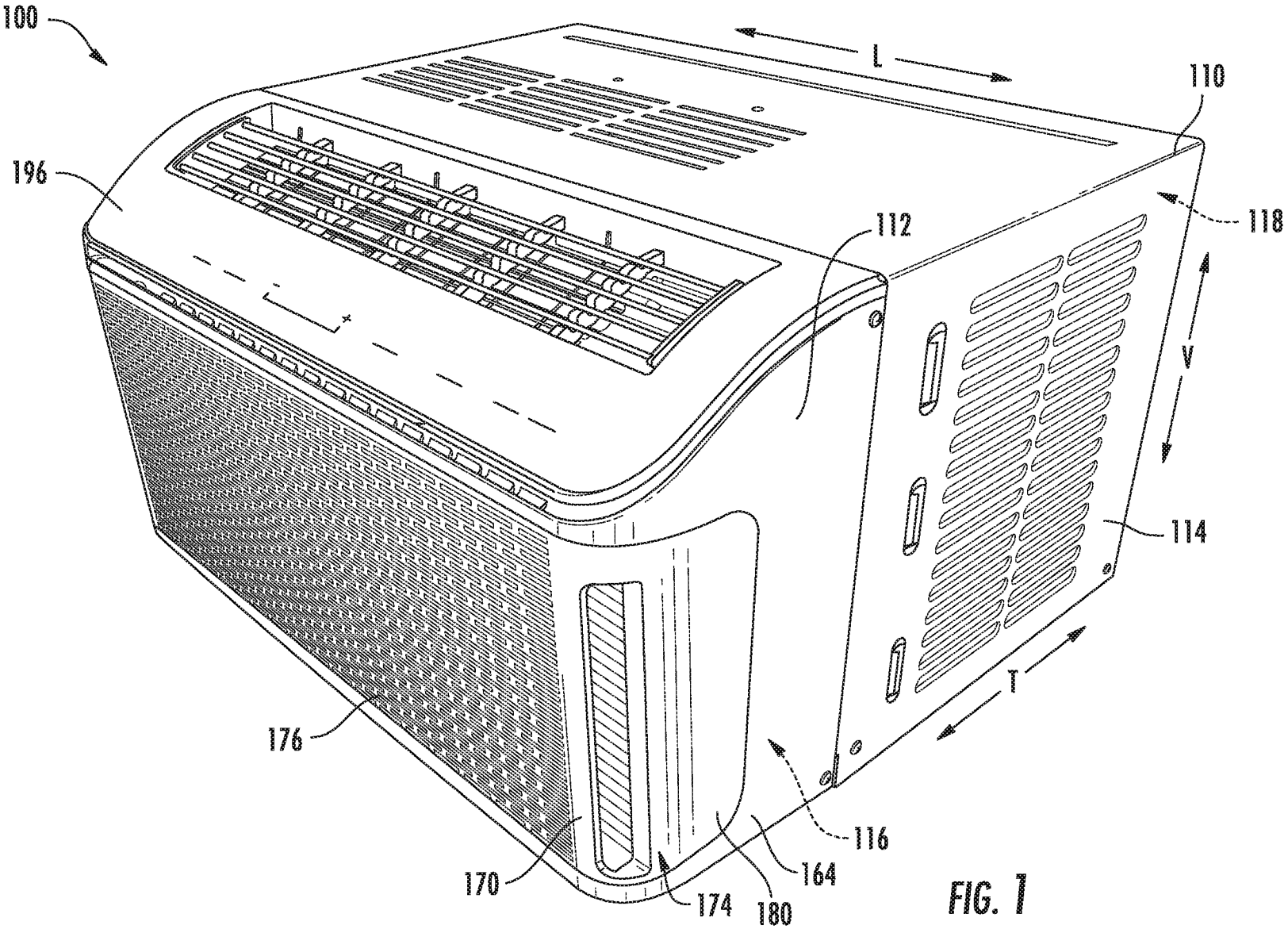
FIG. 1 provides a perspective view of a single-unit air conditioner according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to FIG. 1, an air conditioner 100 is provided. The air conditioner 100 is a one-unit type air conditioner, also conventionally referred to as a window unit. The air conditioner 100 includes an indoor portion 116 and an outdoor portion 118, and generally defines a vertical direction V, a lateral direction L, and a transverse direction T. Each direction V, L, T is perpendicular to each other, such that an orthogonal coordinate system is generally defined.

Although described in the context of a window air conditioner, air conditioner 100, may be provided as a packaged terminal air conditioner unit (PTAC), single-package vertical unit (SPVU), or any other suitable single unit air conditioner. The air conditioner 100 is intended only as an exemplary unit and does not otherwise limit the scope of the present disclosure. Thus, it is understood that the present disclosure may be equally applicable to other types of air conditioners.

A housing 110 of the air conditioner 100 may contain various other components of the air conditioner 100. Housing 110 may include, for example, an outdoor cabinet 114 and an indoor cabinet 112, which may be attached to a base frame. When installed within a room or window, indoor cabinet 112 may be disposed at or contiguous with an interior atmosphere on one side of a window, and outdoor cabinet 114 may be disposed at or contiguous with an exterior atmosphere on the other side of the window. In some such embodiments, outdoor cabinet 114 extends at least partially through the window.

The outdoor cabinet 114 may be part of or define the outdoor portion 118, and the indoor cabinet 112 may be part of or define the indoor portion 116. Components of the outdoor portion 118, such as an outdoor heat exchanger 125, an outdoor fan 148, and a compressor 122 may be housed within the outdoor cabinet 114.

Figure 2:
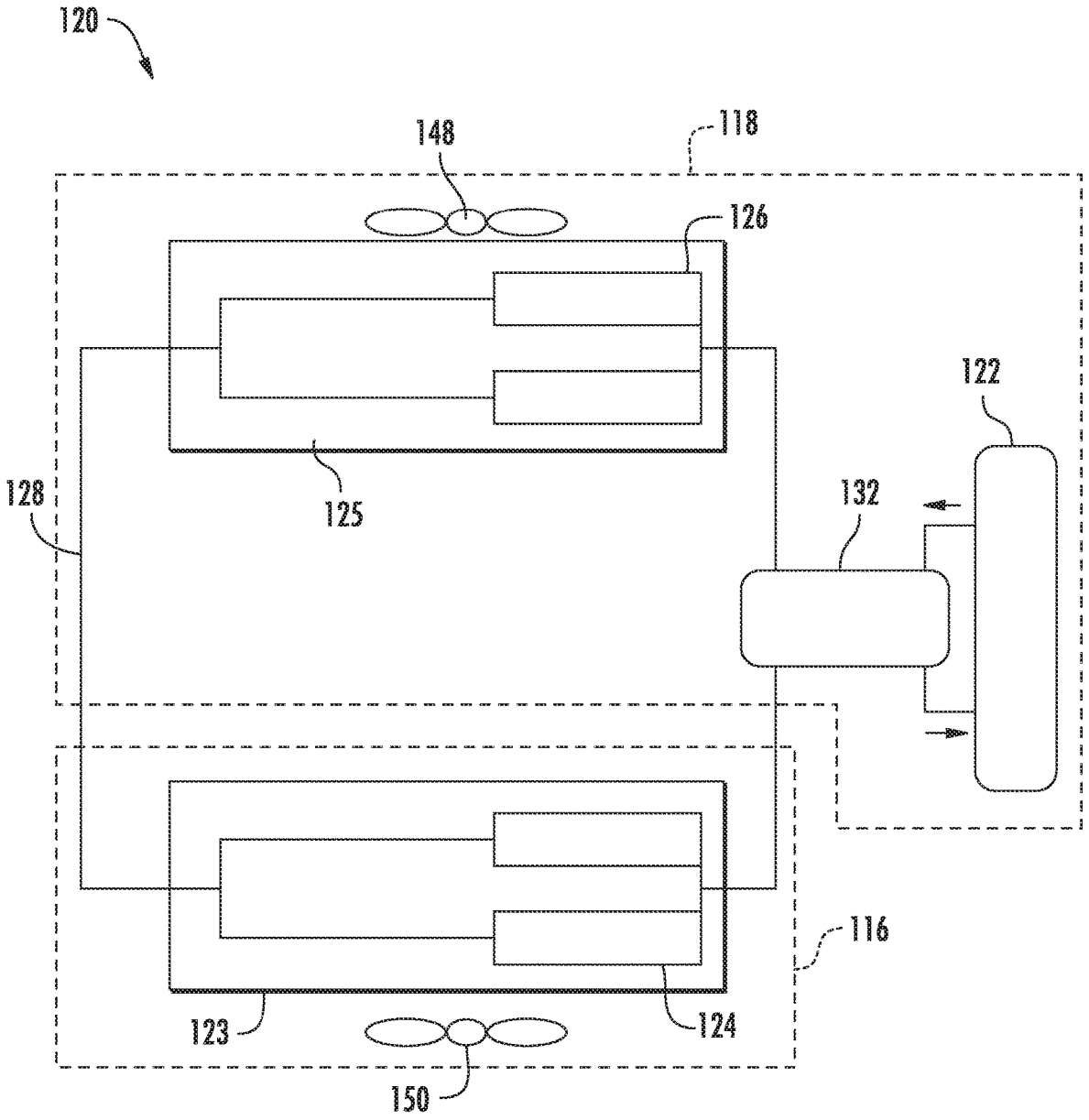
FIG. 2 provides a schematic view of various components of the exemplary single-unit air conditioner of FIG. 1.
Figure 3:
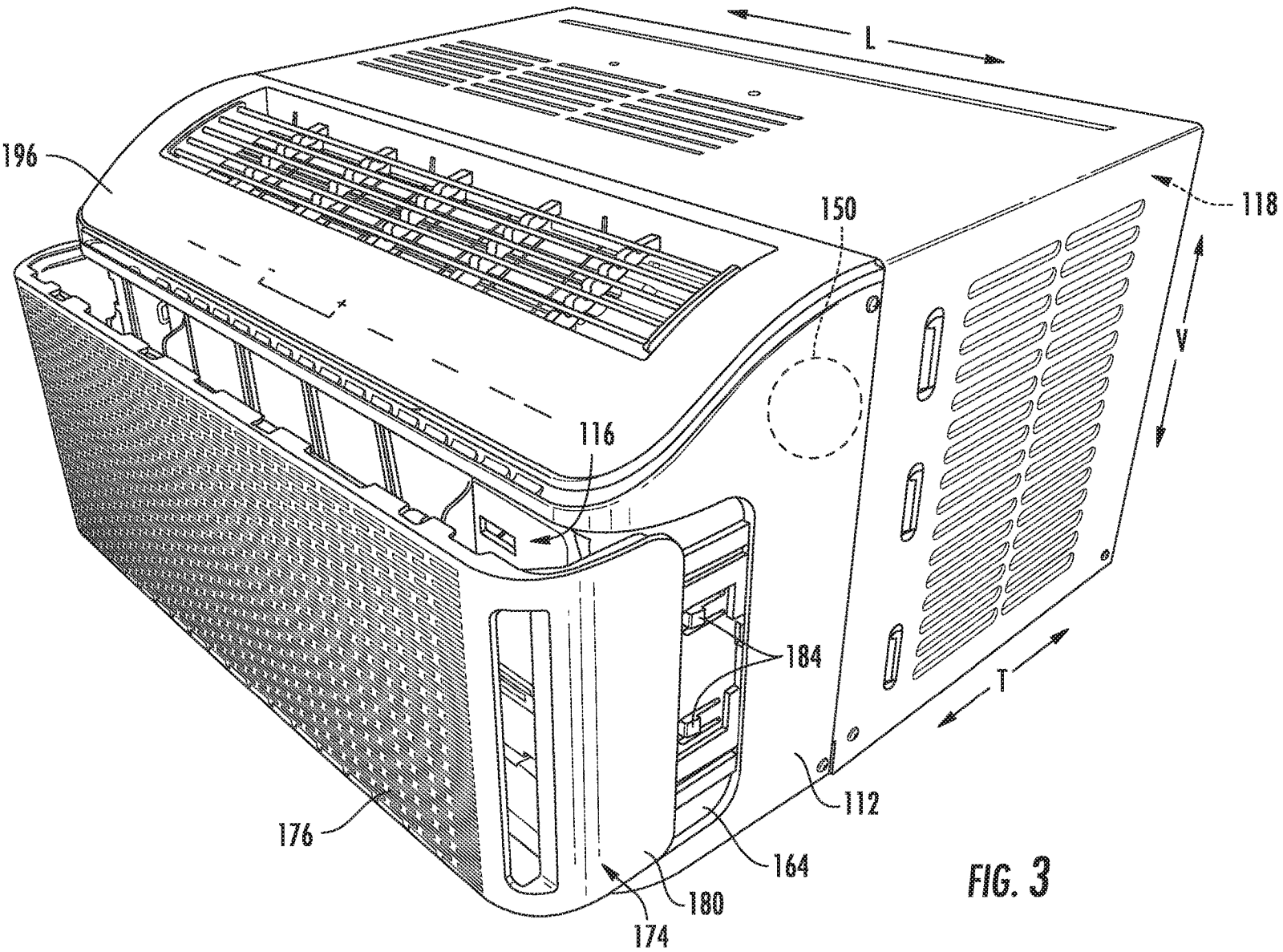
FIG. 3 provides a perspective view of the exemplary single-unit air conditioner of FIG. 1, wherein the front panel is provided in a forward open position.
Figure 4:
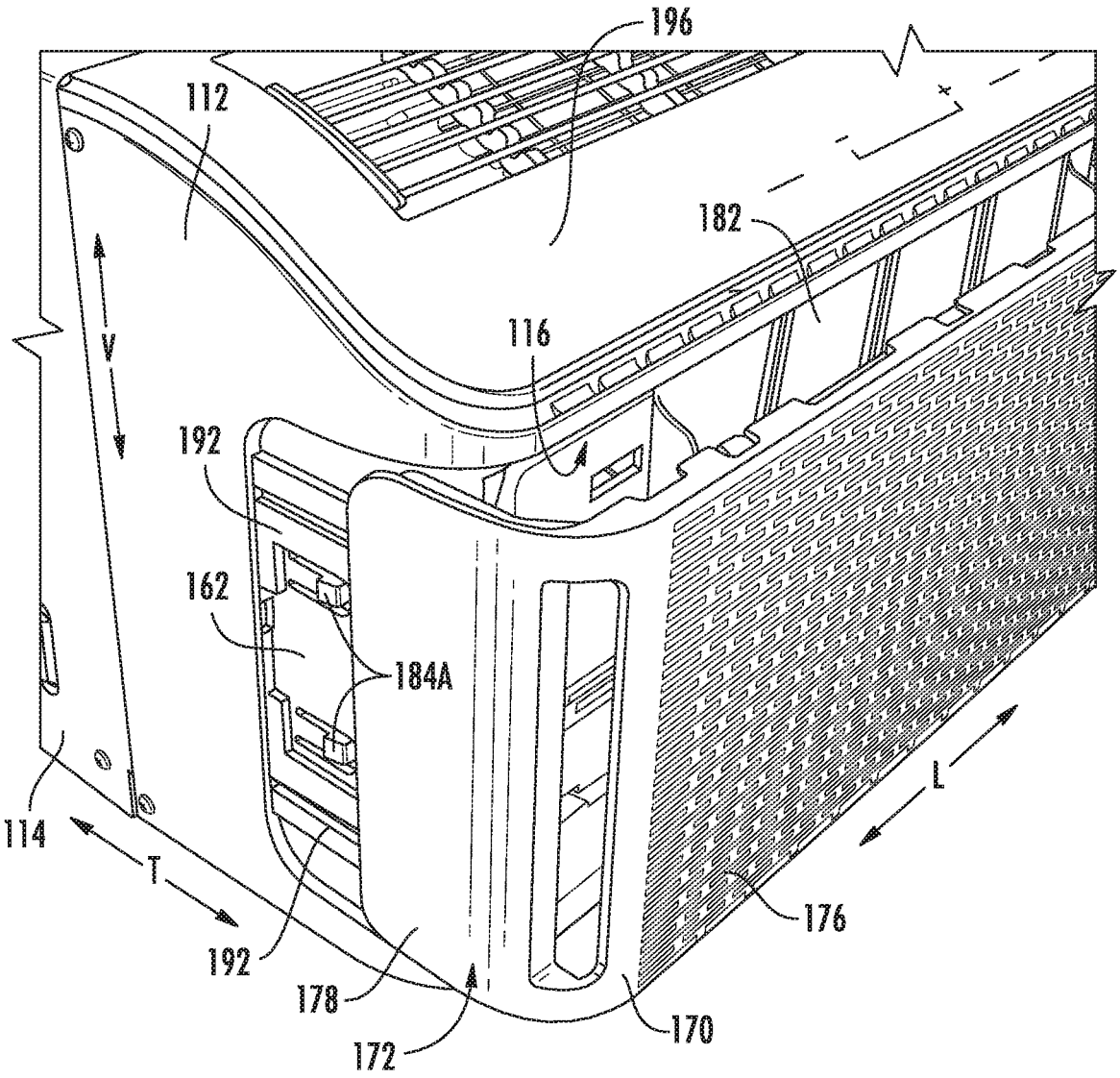
FIG. 4 provides a perspective view of a portion of the exemplary single-unit air conditioner of FIG. 1, wherein the front panel is provided in a forward open position.
Figure 5:
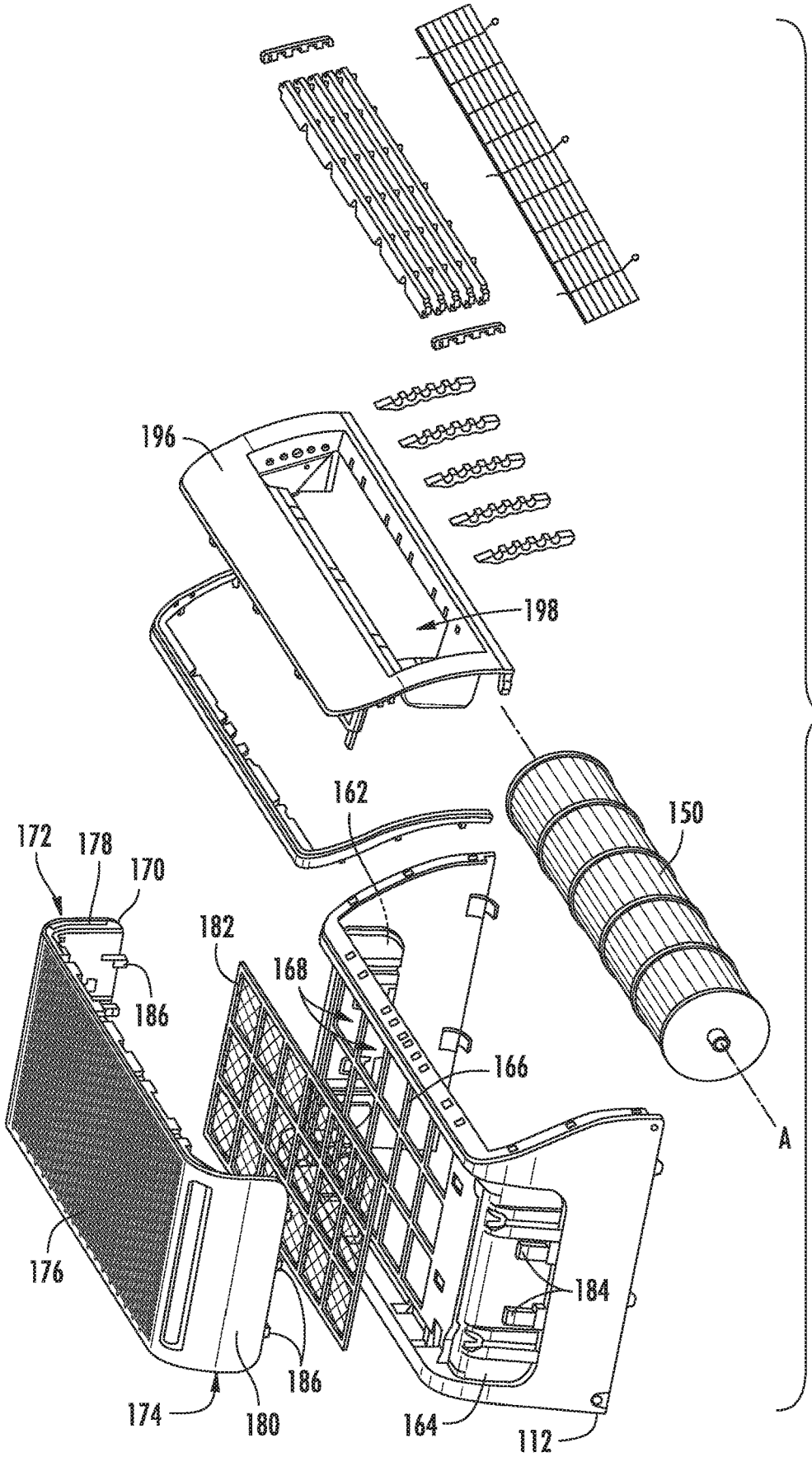
FIG. 5 provides an exploded perspective view of various components of the exemplary single-unit air conditioner of FIG. 1.
Figure 6:
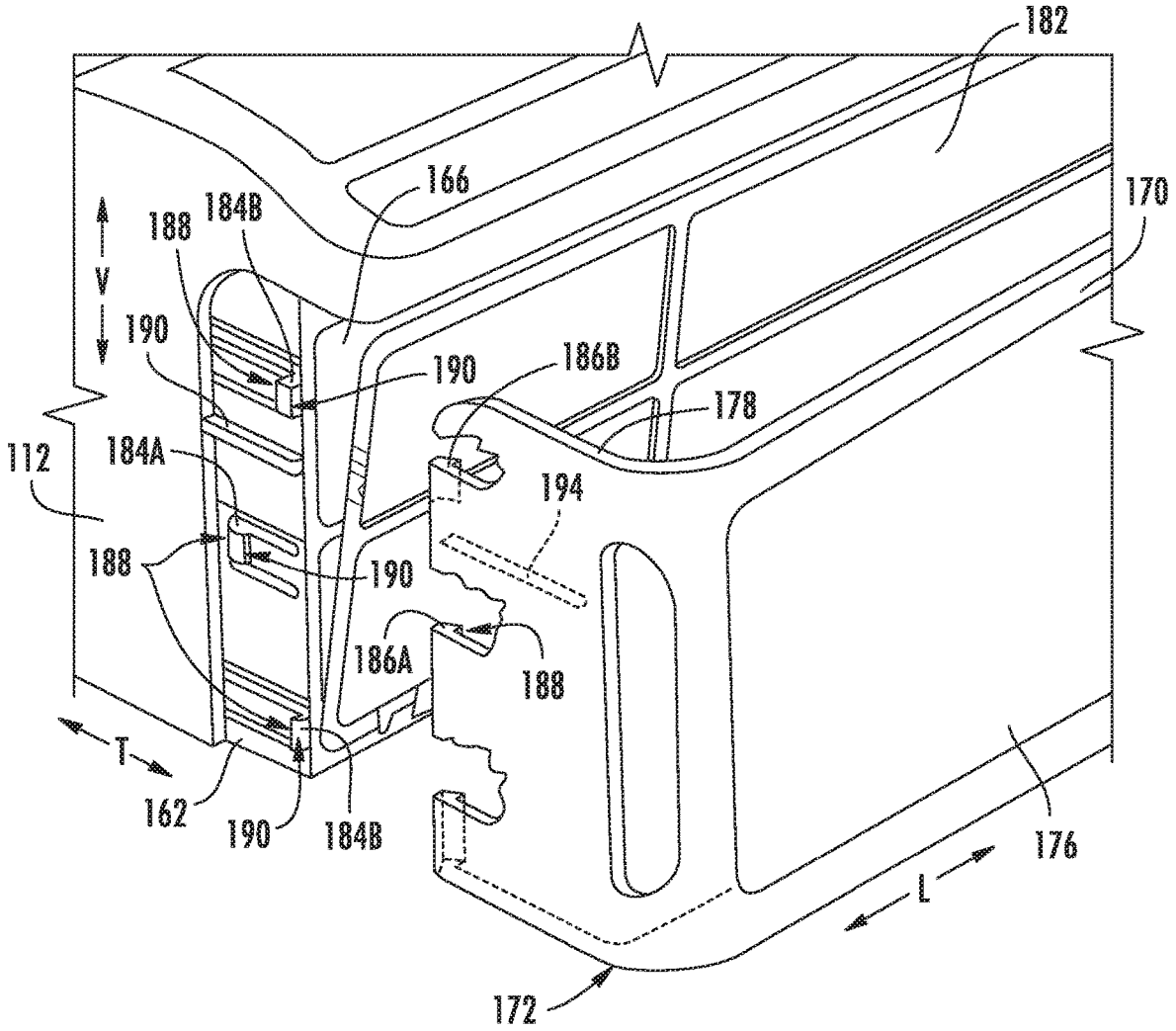
FIG. 6 provides a perspective view of a portion of an exemplary single-unit air conditioner of FIG. 1.

Referring now also to FIG. 2, indoor portion 116 may include, for example, an indoor heat exchanger 123 and an indoor fan 150. These components may, for example, be housed within or behind the indoor cabinet 112. Additionally, a bulkhead (not pictured) may generally support or house various other components or portions thereof of the indoor portion 116, such as the indoor fan 150. Additionally or alternatively, the bulkhead may generally separate and further define the indoor portion 116 and the outdoor portion 118.

Outdoor and indoor heat exchangers 125, 123 may be components of a sealed system 120, which is shown schematically in FIG. 2. As described below, sealed system 120 is generally disposed or positioned within housing 110, and sealed system 120 includes components for transferring heat between the exterior atmosphere and the interior atmosphere.

Window air conditioner 100 further includes a controller (not shown) with user inputs, such as buttons, switches, or dials. The controller regulates operation of window air conditioner 100. Thus, the controller is in operative communication with various components of window air conditioner 100, such as components of sealed system 120 or a temperature sensor, such as a thermistor or thermocouple, for measuring the temperature of the interior atmosphere. In particular, the controller may selectively activate sealed system 120 in order to chill or heat air within sealed system 120 (e.g., in response to temperature measurements from the temperature sensor).

The controller includes memory and one or more processing devices such as microprocessors, CPUs or the like, such as general or special purpose microprocessors operable to execute programming instructions or micro-control code associated with operation of window air conditioner 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor (e.g., using a combination of discrete analog or digital logic circuitry; such as switches, amplifiers, integrators, comparators, flip-flops, AND gates, and the like) to perform control functionality instead of relying upon software.

In certain embodiments, sealed system 120 generally operates in a heat pump cycle. Sealed system 120 includes a compressor 122, an indoor heat exchanger 123 having an interior coil 124, and an outdoor heat exchanger 125 having an exterior coil 126. As is generally understood, various conduits may be utilized to flow refrigerant between the various components of sealed system 120. Thus, for example, interior coil 124 and exterior coil 126 may be between and in fluid communication with each other and compressor 122.

In optional embodiments, sealed system 120 may also include a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at outdoor portion 118 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid or liquid vapor mixture. An outdoor air handler or fan 148 is disposed adjacent to and in fluid communication with exterior coil 126. During use, outdoor fan 148 may facilitate or urge a flow of air from the exterior atmosphere across exterior coil 126 in order to facilitate heat transfer.

Sealed system 120 also includes a capillary tube 128 disposed between interior coil 124 and exterior coil 126 (e.g., such that capillary tube 128 extends between and fluidly couples interior coil 124 and exterior coil 126). Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at indoor portion 116 when sealed system 120 is operating in the cooling mode. For example, the liquid or liquid vapor mixture refrigerant from capillary tube 128 may enter interior coil 124 via a distribution conduit that extends between and fluidly connects interior coil 124 and reversing valve 132. Within interior coil 124, the refrigerant from capillary tube 128 receives energy from the interior atmosphere and vaporizes into superheated vapor or high quality vapor mixture. An indoor air handler or fan 150 is disposed adjacent to and in fluid communication with interior coil 124. During use, indoor fan 150 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser (e.g., such that interior coil 124 is operable to reject heat into the interior atmosphere at indoor portion 116). In addition, exterior coil 126 is disposed downstream of capillary tube 128 in the heating mode and acts as an evaporator (e.g., such that exterior coil 126 is operable to heat refrigerant within exterior coil 126 with energy from the exterior atmosphere at outdoor portion 118).

Interior coil 124 and indoor fan 150 may be disposed within interior casing 112. Conversely, compressor 122, exterior coil 126, reversing valve 132, and outdoor fan 148 may be disposed within exterior casing 114. In such a manner, certain noisy components of sealed system 120 may be spaced from the interior atmosphere, and window air conditioner 100 may operate quietly. Various fluid passages, such as refrigerant conduits, liquid runoff conduits, etc., may extend through housing 110 to fluidly connect components within indoor and outdoor portions 116, 118.

It should be understood that sealed system 120 described above is provided by way of example only. In alternative example embodiments, sealed system 120 may include any suitable components for heating or cooling air with a refrigerant. Sealed system 120 may also have any suitable arrangement or configuration of components for heating or cooling air with a refrigerant in alternative example embodiments.

Turning now especially to FIGS. 3 through 6, various views are provided to illustrate, in particular, aspects of the indoor portion 116, including indoor cabinet 112. As shown, indoor cabinet 112 provides a front casing having a first lateral panel 162 and a second lateral panel 164 spaced apart from each other along the lateral direction L. An internal wall 166 may extend between the first lateral panel 162 and the second lateral panel 164 (e.g., to connect the panels 162, 164 along the lateral direction L). When assembled, internal wall 166 may extend in front of or forward from the indoor heat exchanger 123. In certain embodiments, internal wall 166 defines one or more air openings 168. Air may thus be permitted to the indoor portion 116 (e.g., from an interior room or structure) through the one or more air openings 168, for instance, as motivated by the indoor fan 150.

In certain embodiments, a front panel 170 is selectively or slidably disposed on the indoor cabinet 112. Generally, front panel 170 extends (e.g., along the lateral direction L) from a first lateral end 172 to a second lateral end 174. A faceplate, such as an intake grill 176, may span the lateral distance between first lateral end 172 and second lateral end 174. In some embodiments, a first end wing 178 is included at the first lateral end 172. In additional or alternative embodiments, a second end wing 180 is included at the second lateral end 174. As shown, the first end wing 178 and the second end wing 180 may extend generally rearward (e.g., from the intake grill 176) along the transverse direction T. When fully mounted rearward on indoor cabinet 112, such as in a rearward closed position (FIG. 1), front panel 170 may span or cover at least a portion of indoor cabinet 112. For instance, the intake grill 176 may extend across the internal wall 166 and generally permit air to pass through the intake grill 176 (e.g., along the transverse direction T) to the internal wall 166. Optionally, the first lateral panel 162 or the second lateral panel 164 may be laterally bounded by the first end wing 178 and the second end wing 180, respectively. As an example, the first end wing 178 may be slidably disposed outward (e.g., distal to the indoor portion 116) from the first lateral panel 162 (e.g., which may be proximal to or define at least a portion of the indoor portion 116). As an additional or alternative example, the second end wing 180 may be slidably disposed outward (e.g., distal to the indoor portion 116) from the second lateral panel 164 (e.g., which may be proximal to or define at least a portion of the indoor portion 116).

In certain embodiments, a panel filter 182 can be provided or held within the inner cabinet (e.g., rearward from the front panel 170). For instance, the panel filter 182 may be selectively disposed between the indoor heat exchanger 123 (or more specifically the internal wall 166) and the front panel 170 along the transverse direction T. Generally, the panel filter 182 may include or support any suitable filtration media, such as a woven fiberglass, pleated panels, activated carbon, etc. In exemplary embodiments, a relatively high filtration media may be provided with the panel filter 182. As an example, a MERV-13-rated filtration media may be included with the panel filter 182 to filter or remove particles smaller than 1 μm from air passing through the indoor portion 116 or panel filter 182. Advantageously, the panel filter 182 may be accessed upon separating the front panel 170 from the indoor cabinet 112 (e.g., by moving the front panel 170 from the rearward closed position) and without requiring any further disassembly of the housing 110.

As shown, one or more attachment tabs 184 may be provided at the first lateral panel 162 or the second lateral panel 164. Generally, the attachments tabs 184 may be resilient or elastic members that can be deformed or deflected inward (e.g., toward the indoor portion 116) before returning to their original position. In some embodiments, the attachment tabs 184 extend laterally outward (e.g., away from indoor portion 116 or toward a corresponding end wing 178, 180). In certain embodiments wherein multiple attachment tabs 184 are provided at a single panel (e.g., first lateral panel 162 or second lateral panel 164), at least two or more attachment tabs 184 are spaced apart from each other (e.g., along the vertical direction V). In optional embodiments, the multiple attachment tabs 184 are formed integrally (e.g., as a unitary monolithic member) with a corresponding lateral panel 162, 164.

In some embodiments, one or more lateral ridges 186 are provided at first lateral end 172 or second lateral end 174. For instance, a lateral ridge 186 may extend inward from an interior surface first end wing 178 or second end wing 180. In other words, the lateral ridge 186 may extend generally outward from an inner-portion-facing surface and toward an opposite lateral end. In certain embodiments, the lateral ridge 186 corresponds to at least one of the attachment tabs 184. Optionally, a discrete lateral ridge 186 may correspond to each attachment tab 184. In other words, a plurality of lateral ridges 186 may correspond to a plurality of attachment tabs 184—and vice versa. Additionally or alternatively, a single lateral ridge 186 may extend continuously (e.g., in the vertical direction V) from a top end of the front panel 170 to a bottom end of the front panel 170. In optional embodiments, the lateral ridges 186 are formed integrally (e.g., as a unitary monolithic member) with a corresponding end wing 178, 180.

The attachment tab 184 may form a restriction surface 188 (e.g., flat or transversely-perpendicular surface) to engage a corresponding lateral ridge 186 (e.g., in the transverse direction T). Such a restriction surface 188 may thus generally restrict transversal or sliding movement of the front panel 170 relative to the indoor cabinet 112 (e.g., in the forward direction). Optionally, a tapered or chamfered surface 194 (e.g., angled or non-perpendicular to the transverse direction T) of the attachment tab 184 may be formed on the opposite side of the attachment tab 184 to permit guided transversal or sliding movement of the front panel 170 relative to the indoor cabinet 112 (e.g., in the rearward direction). For instance, the tapered surface 194 may guide lateral deflection of the attachment tab 184 so that the lateral ridge 186 may pass over and along the attachment tab 184 while the attachment tab 184 is naturally deflected (e.g., laterally inward).

In some embodiments, one or more of the attachment tabs 184 (e.g., rearward attachment tabs 184A) correspond to the location of one or more of the lateral ridges 186 in a fully-mounted or closed position. Deflection (e.g., in the lateral direction L) of the rearward attachment tabs 184A or end wing 178, 180 may thus be required to permit the front panel 170 to slide forward (e.g., away from the indoor portion 116 or indoor cabinet 112). Thus, the attachment tabs 184 may hold or secure the front panel 170 on the indoor cabinet 112. Advantageously, the attachment tabs 184 may hold or secure the front panel 170 without the need of any additional mechanical fasteners.

As noted above, the front panel 170 may be slidable (e.g., in the transverse direction T) along the indoor cabinet 112. In certain embodiments, the front panel 170 can selectively slide between a rearward closed position (FIG. 1) and a forward open position (FIGS. 3 and 4) while mounted or attached to indoor cabinet 112. In some such embodiments, the first lateral panel 162 or the second lateral panel 164 includes both a rearward attachment tab 184A and a forward attachment tab 184B. As shown, especially in FIG. 6, the rearward and forward attachment tabs 184A, 184B may be spaced apart along the transverse direction T. In particular, the rearward attachment tab 184A may be disposed proximal to the outdoor portion 118 (e.g., relative to or along the transverse direction T) while the forward attachment tab 184B is disposed distal to the indoor portion 116. In other words, as measured along the transverse direction T, the rearward attachment tab 184A is disposed closer to the outdoor portion 118 than the forward attachment tab 184B is. Additionally or alternatively, the rearward and forward attachment tabs 184A, 184B may be spaced apart along the vertical direction V.

In certain embodiments, a discrete lateral ridge 186A, 186B corresponds to the rearward attachment tab 184A and the forward attachment tab 184B. The first lateral ridge 186A may correspond to the rearward attachment tab 184A, and a second lateral ridge 186B may correspond to the forward attachment tab 184B. Optionally, the first lateral ridge 186A may be vertically aligned with the second lateral ridge 186B. In some embodiments, the locations of the rearward attachment tab 184A and the forward attachment tab 184B correspond to the rearward closed position and the forward open position, respectively. In the rearward closed position, the first lateral ridge 186A may engage the rearward attachment tab 184A (e.g., such that forward movement of the front panel 170 along the transverse direction T from the rearward closed position is restricted). In the forward open position, the second lateral ridge 186B may engage the forward attachment tab 184B (e.g., such that forward movement of the front panel 170 along the transverse direction T from the forward open position is restricted). Moreover, in the forward open position the first lateral ridge 186A may be spaced apart from the rearward attachment tab 184A (e.g., along the transverse direction T). Engagement between second lateral ridge 186B and the forward attachment tab 184B may advantageously impede unintentional removal or extended movement of the front panel 170 relative to the indoor cabinet 112, while still allowing some separation between the front panel 170 (e.g., at the intake grill 176) and the indoor cabinet 112 or panel filter 182.

Between the rearward closed position and the forward open position, transverse movement or sliding of the front panel 170 may be generally unrestricted and neither the first lateral ridge 186A by the second lateral ridge 186B may be engaged with the rearward attachment tab 184A or forward attachment tab 184B.

In optional embodiments, a transversal rail 192 is further formed or included at a lateral panel 162, 164. As shown, the transversal rail 192 may extend along the transverse direction T (e.g., in slidable engagement with the front panel 170). In some such embodiments, a complementary guide surface 194 is formed on a lateral end, such as on the corresponding end wing 178, 180. Engagement between the transversal rail 192 and the complementary guide surface 194 may thus restrict vertical movement of the front panel 170 as the front panel 170 moves to or from the rearward closed position.

Although illustrated as substantially identical or mirrored, it is understood that alternative embodiments of indoor cabinet 112 and front panel 170 may be provided as non-identical or differing elements (e.g., having fewer or more attachment tabs/ridges, one or more uniquely-shaped members, etc.).

As noted above, indoor cabinet 112 may at least partially enclose the indoor fan 150. For instance, the indoor fan 150 may be rotatably disposed within the indoor portion 116 between the first lateral panel 162 and second lateral panel 164. In certain embodiments, the indoor fan 150 includes or is provided as a tangential fan. A rotation axis A of the tangential indoor fan 150 may be defined, for example, parallel to lateral direction L.

When assembled, the indoor fan 150 is disposed rearward from the internal wall 166 and, further, the panel filter 182 or front panel 170. In additional or alternative embodiments, the indoor fan 150 is disposed above the front panel 170 (e.g., along the vertical direction V). Thus, the front panel 170 may be disposed below the indoor fan 150. As shown, a top cover 196 defining an output opening 198 may be disposed above (e.g., directly above) indoor fan 150. Moreover, the top cover 196 may be secured to the indoor cabinet 112 above the front panel 170. Optionally, the top cover 196 may be secured separately from the front panel 170. Advantageously, the top cover 196 would not interfere with movement of the front panel 170 or panel filter 182.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A single-unit air conditioner defining a mutually-orthogonal vertical direction, lateral direction, and transverse direction, the single-unit air conditioner comprising:

a housing defining an outdoor portion and an indoor portion between a first lateral panel and a second lateral panel;

an outdoor heat exchanger assembly disposed in the outdoor portion;

an indoor heat exchanger assembly disposed in the indoor portion;

a compressor in fluid communication with the outdoor heat exchanger assembly and the indoor heat exchanger assembly to circulate a refrigerant therebetween; and a front panel slidably disposed on the housing at the indoor portion, the front panel extending from a first lateral end to a second lateral end, the first lateral end being selectively engaged with the first lateral panel, the first lateral end comprising a lateral ridge directed inward toward a complementary attachment tab formed on the first lateral panel, wherein the first lateral panel further comprises a plurality of attachment tabs extending along the transverse direction on the first lateral panel to engage the front panel, wherein the complementary attachment tab is one attachment tab of the plurality of attachment tabs, wherein the lateral ridge is a first lateral ridge, wherein the front panel further comprises a plurality of lateral ridges corresponding to the plurality of attachment tabs, wherein the front panel is slidable in the transverse direction along the housing between a rearward closed position and a forward open position, and wherein the plurality of attachment tabs comprises a rearward tab and a forward tab spaced apart from the rearward tab along the transverse direction, the rearward tab engaging a first lateral ridge of the plurality of lateral ridges in the rearward closed position, the forward tab engaging a second lateral ridge of the plurality of lateral ridges in the forward open position.

2. The single-unit air conditioner of claim 1, wherein the front panel comprises an intake grill permitting an airflow therethrough.

3. The single-unit air conditioner of claim 1, further comprising a panel filter selectively disposed between the indoor heat exchanger assembly and the front panel along the transverse direction.

4. The single-unit air conditioner of claim 1, wherein the first lateral panel further comprises a transversal rail extending along the transverse direction in slidable engagement with a complementary guide surface formed on the first lateral end.

5. The single-unit air conditioner of claim 1, wherein the second lateral end is selectively engaged with the second lateral panel, the second lateral end comprising a lateral ridge directed inward toward a complementary attachment tab formed on the second lateral panel.

6. The single-unit air conditioner of claim 1, further comprising an indoor fan rotatably disposed within the indoor portion in fluid communication with the indoor heat exchanger assembly.

7. The single-unit air conditioner of claim 6, wherein the indoor fan is a tangential fan defining a rotation axis parallel to the lateral direction.

8. A single-unit air conditioner defining a mutually-orthogonal vertical direction, lateral direction, and transverse direction, the single-unit air conditioner comprising:

a housing defining an outdoor portion and an indoor portion between a first lateral panel and a second lateral panel;

an outdoor heat exchanger assembly disposed in the outdoor portion;

an indoor heat exchanger assembly disposed in the indoor portion;

a compressor in fluid communication with the outdoor heat exchanger assembly and the indoor heat exchanger assembly to circulate a refrigerant therebetween;

an indoor fan rotatably disposed within the indoor portion in fluid communication with the indoor heat exchanger assembly; and a front panel slidably disposed on the housing at the indoor portion below the indoor fan along the vertical direction, the front panel extending from a first lateral end to a second lateral end, the first lateral end being selectively engaged with the first lateral panel, the first lateral end comprising a lateral ridge directed inward toward a complementary attachment tab formed on the first lateral panel, wherein the first lateral panel further comprises a plurality of attachment tabs extending along the transverse direction on the first lateral panel to engage the front panel, wherein the complementary attachment tab is one attachment tab of the plurality of attachment tabs, wherein the lateral ridge is a first lateral ridge, wherein the front panel further comprises a plurality of lateral ridges corresponding to the plurality of attachment tabs, wherein the front panel is slidable in the transverse direction along the housing between a rearward closed position and a forward open position, and wherein the plurality of attachment tabs comprises a rearward tab and a forward tab spaced apart from the rearward tab along the transverse direction, the rearward tab engaging a first lateral ridge of the plurality of lateral ridges in the rearward closed position, the forward tab engaging a second lateral ridge of the plurality of lateral ridges in the forward open position.

9. The single-unit air conditioner of claim 8, wherein the front panel comprises an intake grill permitting an airflow therethrough.

10. The single-unit air conditioner of claim 8, further comprising a panel filter selectively disposed between the indoor heat exchanger assembly and the front panel along the transverse direction.

11. The single-unit air conditioner of claim 8, wherein the first lateral panel further comprises a transversal rail extending along the transverse direction in slidable engagement with a complementary guide surface formed on the first lateral end.

12. The single-unit air conditioner of claim 8, wherein the second lateral end is selectively engaged with the second lateral panel, the second lateral end comprising a lateral ridge directed inward toward a complementary attachment tab formed on the second lateral panel.

13. The single-unit air conditioner of claim 8, wherein the indoor fan is a tangential fan defining a rotation axis parallel to the lateral direction.

14. A single-unit air conditioner defining a mutually-orthogonal vertical direction, lateral direction, and transverse direction, the single-unit air conditioner comprising:

a housing defining an outdoor portion and an indoor portion between a first lateral panel and a second lateral panel;

an outdoor heat exchanger assembly disposed in the outdoor portion;

an indoor heat exchanger assembly disposed in the indoor portion;

a compressor in fluid communication with the outdoor heat exchanger assembly and the indoor heat exchanger assembly to circulate a refrigerant therebetween;

a front panel slidably disposed on the housing at the indoor portion, the front panel extending from a first lateral end to a second lateral end, the first lateral end being selectively engaged with the first lateral panel, the first lateral end comprising a lateral ridge directed inward toward a complementary attachment tab formed on the first lateral panel; and a panel filter selectively disposed between the indoor heat exchanger assembly and the front panel along the transverse direction, wherein the first lateral panel further comprises a plurality of attachment tabs extending along the transverse direction on the first lateral panel to engage the front panel, and a transversal rail extending along the transverse direction in slidable engagement with a complementary guide surface formed on the first lateral end, wherein the complementary attachment tab is one attachment tab of the plurality of attachment tabs, wherein the lateral ridge is a first lateral ridge, wherein the front panel further comprises a plurality of lateral ridges corresponding to the plurality of attachment tabs, wherein the front panel is slidable in the transverse direction along the housing between a rearward closed position and a forward open position, and wherein the plurality of attachment tabs comprises a rearward tab and a forward tab spaced apart from the rearward tab along the transverse direction, the rearward tab engaging a first lateral ridge of the plurality of lateral ridges in the rearward closed position, the forward tab engaging a second lateral ridge of the plurality of lateral ridges in the forward open position.

15. The single-unit air conditioner of claim 14, wherein the front panel comprises an intake grill permitting an airflow therethrough.

16. The single-unit air conditioner of claim 14, wherein the second lateral end is selectively engaged with the second lateral panel, the second lateral end comprising a lateral ridge directed inward toward a complementary attachment tab formed on the second lateral panel.

17. The single-unit air conditioner of claim 14, further comprising an indoor fan rotatably disposed within the indoor portion in fluid communication with the indoor heat exchanger assembly.

18. The single-unit air conditioner of claim 17, wherein the indoor fan is a tangential fan defining a rotation axis parallel to the lateral direction.

* * * * *